United States Patent [19]

Flottorp

[11] 4,366,633

[45] Jan. 4, 1983

[54] SAFETY TOE CAP

[76] Inventor: Thomas R. Flottorp, 207 Argyle St., Regina, Saskatchewan, S4R 4C5, Canada

[21] Appl. No.: 192,817

[22] Filed: Oct. 1, 1980

[30] Foreign Application Priority Data

Nov. 9, 1979 [CA] Canada ..... 339560

[51] Int. Cl.[3] ..... A43B 3/24; A43C 13/14

[52] U.S. Cl. ..... 36/101; 36/77 R

[58] Field of Search ..... 36/100, 101, 77 R, 77 M, 36/68, 72 R

[56] References Cited

U.S. PATENT DOCUMENTS

| | | | |
|---|---|---|---|
| 3,812,601 | 5/1974 | Flottorp | 36/101 |
| 4,011,667 | 3/1977 | Greenan | 36/77 R |
| 4,103,438 | 8/1978 | From | 36/77 R |

*Primary Examiner*—Patrick D. Lawson

*Attorney, Agent, or Firm*—Robert Scobey

[57] ABSTRACT

In footwear of most varieties including boots and shoes, there is described improved footwear wherein the upper or boot portion of the footwear, including a safety toe cap, is detachably connected to the lower or heel and sole portion of the footwear. Known footwear is integrally formed such that damage to the safety toe cap necessitates replacement of the footwear if the safety features of the boot are to be maintained. In this invention, releasable fasteners such as hooks are deployed about the periphery of the sole. These hooks engage a continuous flexible wire which extends around the lower periphery of the upper portion of the footwear. A toe cap is formed with similar hook fasteners along its lower periphery which also engage the flexible wire. The toe cap hooks are spaced to fit between the hooks deployed about the periphery of the sole when installed. Accordingly, the toe cap may be secured to the upper portion prior to attachment of the upper portion to the sole. Inward pressure applied to the lower edge of the upper portion will release the upper portion and thereby facilitates repair or replacement of the toe cap.

5 Claims, 7 Drawing Figures

SAFETY TOE CAP

The present invention relates to a new and useful improvements in the construction of footwear, particularly boots, shoes and the like. Although a shoe construction is described and illustrated herein, nevertheless it is to be appreciated that the invention is applicable to any form of boot and shoe construction and includes overshoes, rubbers, work boots and in fact any form of footwear with the exception of footwear in which the uppers consist merely of a few strips of material.

Typically footwear is manufactured in one piece so that a specific pair of shoes or boots is required for various purposes such as one pair for work and another pair for casual or dress use.

The only way the upper portions of footwear can be altered is by means of dye or paint but this, of course, will have no effect in terms of adapting the footwear so as to be more suitable for a particular purpose.

Furthermore, it is often difficult for the wearer to obtain a shoe or boot construction which is exactly suitable for use with his or her particular foot.

The use of safety footwear has been promoted in recent years as a means of reducing foot injuries. Such footwear usually includes a toe cap which is adapted to resist shock loads and prevent crushing of the wearer's toes. It has previously been necessary to buy a specific item of footwear which has these safety features. Such footwear is usually heavier than normal and so is unsuitable for general use. This has made it expensive to have a variety of safety footware suitable for different clothes and has generally inhibited the use of such footwear in the work environment.

A further problem associated with safety footwear is that damage to the toe cap may render the shoe unsafe. A small dent in the toe cap may be insufficient to prevent use of the footwear but may cause structural weakness. However, since it is necessary to change the whole shoe to provide a new toe cap, the footwear will continue to be used even though it no longer provides the necessary margin of safety.

It is an object of the present invention to obviate or mitigate the above disadvantages.

According to the present invention there is provided footwear comprising an upper portion, a sole and heel portion, releasable fastening means extending around the periphery of the portions to connect selectively the upper portion with the sole and heel portion and a toe cap releasably connected to one of the portions to be secured thereto upon assembly of upper portion and the sole and heel portion.

According to a further aspect of the present invention there is provided for use with footwear having an upper portion releasably connected to a sole and heel portion by releasable fastening means extending around the periphery of the portions, a toe cap having connecting means to connect the toe cap to one of the portions so as to be secured thereto upon assembly of the portions. An embodiment of the invention will now be described by way of example only with reference to the accompanying drawings, in which.

Proceeding therefore to describe the invention in detail, reference should be made to the accompanying drawings in which a shoe construction is shown. However as mentioned previously, this is illustrative only and is adaptable for use with any form of footwear with the exception of footwear which includes strips of material for the upper portion.

Figure 1:
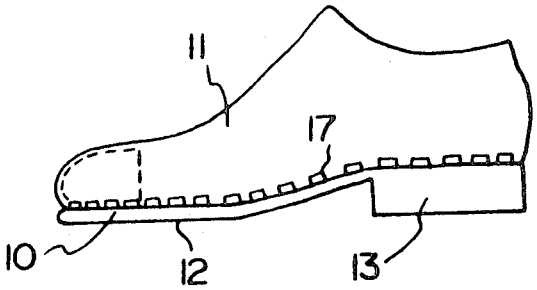
FIG. 1 is a side elevation of an item of footwear having a sole and heel portion and an upper portion.

FIG. 1 shows a shoe having a sole and heel portion 10 and an upper portion 11. The sole and heel portion includes a planar sole 12 together with a heel 13 secured thereto. The sole may be manufactured of rubber, leather, plastic or other suitable material.

Figure 2:
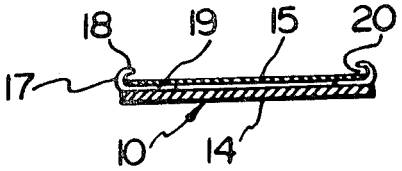
FIG. 2 is an enlarged cross-sectional view of the sole and heel portion of FIG. 1.

Referring now to FIG. 2, the sole includes a ground engaging lower sole 14 which is covered by a relatively thin upper sole 15 of flexible material which once again can be leather, fabric or plastic as desired.

Figure 3:
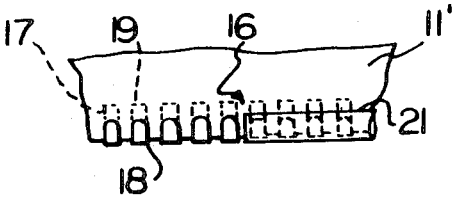
FIG. 3 is an enlarged fragmentary plan view of a portion of the sole portion of FIG. 1.
Figure 7:
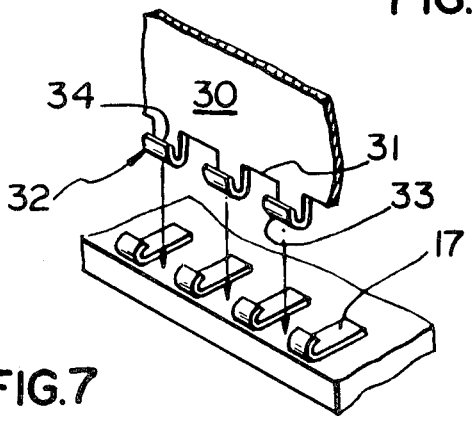
FIG. 7 is an enlarged fragmentary isometric view of one edge of the sole and associated toe cap. In the drawings like characters of reference indicate corresponding parts in the different figures.

Extending all around the perimeter of the lower sole 14 is a hook assembly collectively designated 16 and shown in detail in FIGS. 1, 3 and 7.

This assembly comprises a plurality of individual hooks 17 manufactured from flat, relatively narrow spring steel and includes hook portions 18 and leg portions 19, it being observed that hook portions 18 are relatively short and are situated in a plane above the legs 19 which extend inwardly therefrom.

The inner or what might be termed the open ends 20 of the hook portions 18 may be curved downwardly slightly and when in position, face inwardly from the perimetrical edge. The hooks 17 are located upon the upper side of the sole 14 with the hook portions spaced just above this upper side as clearly shown in FIG. 2. The hooks are placed around the perimeter of the sole 14 whereupon the upper sole 15 is adhesively secured in position or, if necessary, stitched to the sole 14 thus holding the hook firmly by the legs 19 which are sandwiched between the sole portions 14 and 15 as clearly shown. Alternatively, the hook 17 may be molded into the sole 14 during manufacture.

A flexible plastic strip 21 (FIG. 3) is also secured between the soles 14 and 15 and covers the hooks 17 all around the perimeter so that the hooks are hidden and water-proofed. This strip is attached to the hook portions 18 by adhesive.

Figure 4:
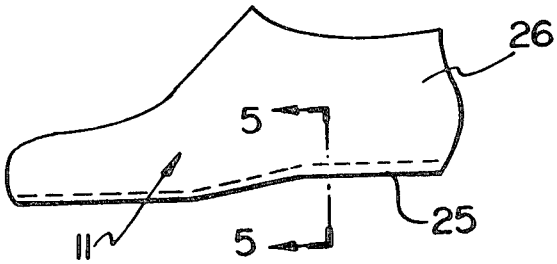
FIG. 4 is a side elevation of the upper portion per se.
Figure 5:
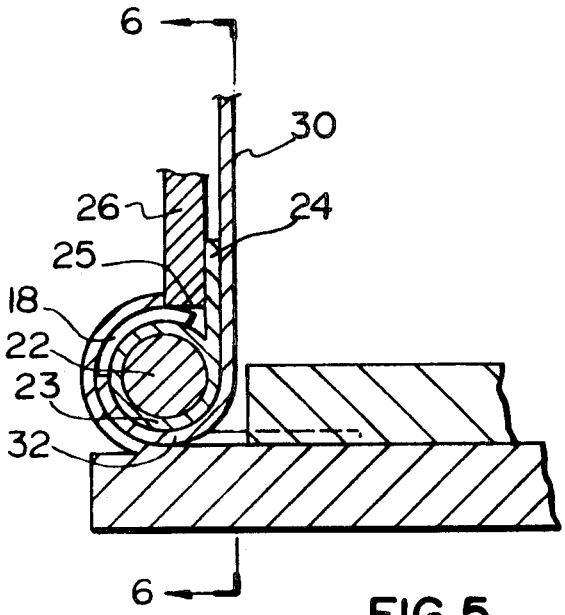
FIG. 5 is an enlarged cross-sectional view along the line 5—5 of FIG. 4.

Referring now to FIGS. 4 and 5, the upper portion 11 may be manufactured in any conventional manner but is open based. Around a lower perimeter 25 of an upper side wall 26 is situated a flexible wire 22 covered by a strip of cloth-like material 23 which loops once around the wire and terminates in the flanged portion 24. The flanged portion 24 is adhesively or stitchably secured internally of the lower perimeter 25 of the upper side wall 26 of the portion 11. This construction is shown in FIG. 5 although stitching is not illustrated.

Figure 6:
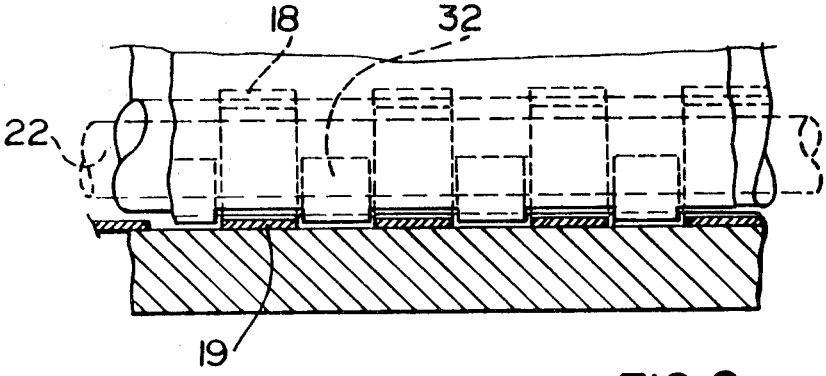
FIG. 6 is a view on the line 6—6 of FIG. 5.

A toe cap 30 of generally spherical curvature is manufactured from steel or reinforced plastics material. The toe cap 30 has a lower edge 31 which is shaped to conform to the periphery of the sole 14. The lower edge 31 is formed with a number of hooks 32. Each hook 32 has a curved portion 33 which defines an upwardly facing opening 34. As can best be seen in FIGS. 6 and 7, the toe cap hooks 32 are spaced so as to locate between the hooks 17 of hook assembly 16.

In operation the toe cap 30 is positioned within the upper portion 11 so that the fabric covered wire 22 is located within the hooks 32. The upper portion 11 is then assembled on the sole and heel portion 10 by snapping the wire 22 under the hooks 17.

The hooks are covered externally by plastic strip 21 all around the perimeter of the sole 12 thus securing the upper portion firmly to the sole and heel portion 10 and sealing same against ingressive moisture. Furthermore the weight of the user during use assists in maintaining this seal.

In order to detach the upper portion 11 it is merely necessary to press same inwardly by the lower edges thereof so that the wire 22 disengages from the hooks 17 whereupon the upper portion can be removed and another upper portion can be engaged. Similarly, the toe cap 30 may be removed by detaching the wire 22 from the hooks 32.

It will be seen therefore that the toe cap may be selectively used to provide safety footwear with a number of different shoe styles. Further, a damaged toe cap may be readily replaced without requiring an entirely new shoe. The particular arrangement of hooks disclosed ensures that the toe cap is securely held within the shoe. The edge of the toe cap is also supported on the periphery of the sole to provide adequate strength.

The embodiments of the invention in which an exclusive property or privilege is claimed are defined as follows:

1. Foot wear comprising an upper portion and a sole and heel portion; fastening means extending around the periphery of said portions to detachably connect said upper and said sole and heel portions, said fastening means including a plurality of hooks spaced around the periphery of one of said portions and a continuous wire extending around the periphery of the other of said portions, said hooks partially encompassing said wire to connect said portions; and a toe cap including a peripheral portion having a plurality of hooks formed thereon to receive said continuous wire for detachably securing said toe cap between said upper and said heel and sole portions.

2. The footwear of claim 1, wherein said plurality of hooks spaced around the periphery of one of said portions are secured to said sole and heel portion of said continuous wire extends around the periphery of said upper portion.

3. The footwear of claim 2, wherein said hook members formed on said toe cap are arranged to locate between said hooks on the periphery of said heel and sole portion.

4. The footwear of claim 3, wherein said toe cap may be secured to said upper portion prior to connection of said upper portion to said sole and heel portion.

5. The footwear of claim 4, wherein said hook members formed on said toe cap are curved to open upwardly.

* * * * *